US007332145B2

(12) United States Patent
Chretien

(10) Patent No.: US 7,332,145 B2
(45) Date of Patent: Feb. 19, 2008

(54) PROCESS AND INSTALLATION FOR THE TREATMENT OF DSO

(75) Inventor: Denis Chretien, Saint Mande (FR)

(73) Assignee: Total S.A. (FR)

( * ) Notice: Subject to any disclaimer, the term of this patent is extended or adjusted under 35 U.S.C. 154(b) by 223 days.

(21) Appl. No.: 11/221,915

(22) Filed: Sep. 9, 2005

(65) Prior Publication Data

US 2006/0057056 A1 Mar. 16, 2006

(30) Foreign Application Priority Data

Sep. 10, 2004 (FR) ..... 04 09616

(51) Int. Cl.
*B01J 19/00* (2006.01)
*C01B 17/04* (2006.01)

(52) U.S. Cl. ..... 423/573.1; 423/574.1; 423/576.8; 423/242.1; 423/242.7; 62/611; 568/21; 568/26; 422/129; 422/168; 422/187; 422/188

(58) Field of Classification Search ..... 423/573.1, 423/574.1, 576.8, 242.1, 242.7; 62/611; 568/21, 26; 422/129, 168, 187, 188
See application file for complete search history.

(56) References Cited

U.S. PATENT DOCUMENTS

| | | | | |
|---|---|---|---|---|
| 3,331,214 | A * | 7/1967 | Proctor et al. | 62/611 |
| 4,265,735 | A * | 5/1981 | Audeh et al. | 208/234 |
| 6,735,979 | B2 * | 5/2004 | Lecomte et al. | 62/611 |
| 6,793,712 | B2 * | 9/2004 | Qualls | 95/92 |
| 2005/0287056 | A1 * | 12/2005 | Baker et al. | 423/242.1 |

* cited by examiner

*Primary Examiner*—Timothy C. Vanoy
(74) *Attorney, Agent, or Firm*—Dickstein, Shapiro, LLP.

(57) ABSTRACT

Disclosed is a process for the treatment of gas containing mercaptans and acid gases, including the following steps: (1) separating the acid gases from the said gas and obtaining a sweetened gas and the flow of acid gases containing $H_2S$; (2) reacting the $H_2S$ thus obtained in step (1) according to the Claus reaction; (3) concentrating the mercaptans in at least one cut of the said sweetened gas; (4) extracting the mercaptans of the said cut; and further comprising: (5) transforming the mercaptans into dialkyl-disulfide (DSO); (6) hydrogenating DSO into $H_2S$; and (7) reacting the $H_2S$ thus obtained at step (6) according to the Claus reaction. An installation for carrying out this procedure is also described.

27 Claims, 4 Drawing Sheets

PROCESS AND INSTALLATION FOR THE TREATMENT OF DSO

FIELD OF THE INVENTION

The present invention relates to a process for the hydrogenation of disulfides (DSO) resulting from the transformation of the mercaptans contained in Liquefied Petroleum Gas (LPG), into hydrogen sulfide and hydrocarbons and their conversion in Claus units. The process applies equally well to natural gas liquefaction plants as to natural gas or refinery gas treatment plants

BACKGROUND ART

A natural gas extracted from subsoil is, under normal conditions of temperature and pressure, a mixture of gaseous hydrocarbons. Typically, a natural gas is, for example constituted of 75% methane, 20% other gaseous hydrocarbons, dominantly ethane, and 5% acid gases, namely carbon dioxide ($CO_2$) and hydrogen sulfide ($H_2S$). Liquefied Petroleum Gas (GLP) are generally mainly formed of three- or four-carbon-chain gaseous hydrocarbons, i.e. propane, butane and their unsaturated versions propene and butene. Accompanying these components are traces of contaminants, essentially sulfurous compounds, namely sulfur carbonyl (COS) and mercaptans. The mercaptans are principally divided into methyl-mercaptan ($CH_3SH$), ethyl-mercaptan ($C_2H_5SH$), propyl-mercaptan ($C_3H_7SH$) and possibly higher molecular weight mercaptans.

The more acidic a natural gas is, that is to say the more carbon dioxide and hydrogen sulfide it contains, the higher is its content of sulfurous compounds and consequently mercaptans. In certain natural gas deposits the mercaptans content can therefore exceed the limit tolerated for a commercial natural gas. Therefore, whether the gas is to be sold in gas or liquid form, the mercaptans must be extracted.

Because the gases containing the mercaptans are acidic, they are subjected to a first step of de-acidification in order to extract $H_2S$ and $CO_2$. However, the mercaptans are only slightly extracted when classical processes of de-acidification, that are most often washings with amine solutions, are used. It is thought that barely not more than one third, if not one quarter, of mercaptans present in natural gas is absorbed in this way. Their extraction necessitates, therefore, a supplementary extraction. Two types of treatment are commonly used today: adsorption by a molecular sieve or cryogenic condensation.

U.S. Pat. No. 5,291,736 and U.S. Pat. No. 5,659,109 indicate that the cryogenic condensation of LPG is accompanied by that of the mercaptans. The mercaptans are then found concentrated in the condensed liquids.

The article <<Gas processing options for mercaptans and carbonyl sulfide removal from NG and NGL streams>> (UOP, AIChE 1993, Spring National Meeting, Houston, Tex., Mar. 28 to Apr. 1, 1993) shows flow sheets of three plants, the first of which (plant A—FIG. 1) is a liquefaction plant for gases with a high sulfurous compound content. It indicates that the LPG products are highly contaminated by the simultaneously condensed mercaptans and that the latter concentrate naturally in the propane and the butane. The mercaptan content measured in the LPG reaches levels of 112 and 288 ppm by weight in the propane and in the butane, respectively. These commercially unacceptable levels make necessary the treatment of the LPG.

Irregardless of the origin of the condensed hydrocarbons—extraction from a subsoil natural gas or from a refinery gas, the cryogenic condensation during the cooling producing the liquefaction of the natural gas—the hydrocarbon liquid mixture is essentially made up of ethane mixed with heavier hydrocarbons. It is observed that the methyl- and ethyl-mercaptans concentrate preferentially in the butane and the propane while the propyl-mercaptans and the heavier mercaptans stay in the condensates. The following description focuses on the LPG butane and propane cuts, but the process according to the invention is also applicable to all cuts (for example condensate) as long as their density permits treatment by washing with sodium hydroxide (see below). The sulfur content in the butane and propane is therefore high, frequently greater than 1000 ppm, if not greater than 1%.

At such high content levels, mercaptan extraction from the propane and butane cuts cannot be done using molecular sieves. It is carried out by washing with sodium hydroxide, an example of which is given for methylmercaptan:

$$2CH_3SH+2NaOH \rightarrow 2CH_3SNa+2H_2O$$

The regeneration of the sodium hydroxide solution with oxygen transforms the mercaptans into disulfide.

$$2CH_3SNa+\tfrac{1}{2}O_2+H_2O \rightarrow CH_3SSCH_3+2NaOH$$

The general reaction can be written:

$$2CH_3SH+\tfrac{1}{2}O_2 \rightarrow (CH_3S)_2+H_2O$$

Two methylmercaptan molecules give one dimethyldisulfide molecule. The reaction is similar for the other mercaptans. The mixture of disulfides obtained from the mercaptans according to this reaction is known as Disulfide oil (DSO).

To get rid of the DSO, the most standard practice consists of mixing it with hydrocarbon cuts (condensates, naphtha or others) to be treated afterward in the refinery. However, mainly in gas treatment plants, it happens that such cuts are not available, thus making then necessary the treatment of DSO in situ.

A practical way to eliminate the DSO is to treat it by oxidation jointly with $H_2S$, in a Claus reaction-based sulfur recuperation unit according to the following reaction for, given as an example, dimethyldisulfide:

$$(CH_3S)_2+1\tfrac{1}{2}O_2 \rightarrow 2CO_2+2SO_2+3H_2O$$

However, for the reaction to reach completion it must be carried out in the presence of an excess, with respect to the stoichiometry, of oxygen, whereas the $H_2S$ oxidation reaction in a Claus unit takes places in the absence of oxygen. The quantity of DSO that is possible to incinerate jointly with $H_2S$ is therefore limited and often inferior to that produced during the treatment of LPG. Today this method has not yet been used industrially.

Another way to eliminate the DSO is to incinerate it, outside of a Claus unit. For total combustion to occur, it must be carried out in an excess of air. The smoke resulting from the combustion contains sulfur dioxide, $SO_2$. It can be introduced into the Claus unit but the residual oxygen still present in the smoke must be first separated. It is thus necessary to wash the smoke with a physical solvent that separates the sulfur dioxide from the residual oxygen and concentrates the former before injection into the Claus unit. This technique, however, presents the inconvenience of operating in a very corrosive medium and of requiring the use of noble metallurgical products for the equipment, for example, stainless steel. An industrial application of this process is being carried out in the Dolphin treatment plant, a plant fed by North Dome natural gas The invention, contrary to the two aforementioned processes, relates to the treatment of DSO integrated into the whole sulfur treatment chain of a gas treatment plant.

SUMMARY OF THE INVENTION

The process, according to the invention, relates to the hydrogenation of DSO obtained by the transformation of mercaptans. The principal products of the hydrogenation are hydrogen sulfide and hydrocarbons. The $H_2S$ (preferentially separated from the hydrocarbons by washing with a basic amine solution) is sent to a Claus reaction-based sulfur production unit. The invention is applicable to the treatment of gas containing acid gases (sour gas) and mercaptans.

The invention proposes consequently a process of treatment of a gas containing mercaptans and acid gases, including the following steps:

(1) separating acid gases from the aforesaid gas and obtaining a sweetened gas and an acid gas flow containing $H_2S$;

(2) reacting the $H_2S$ thus obtained in step (1) according to the Claus reaction;

(3) concentrating the mercaptans in at least one cut of the aforesaid sweetened gas;

(4) extracting the mercaptans from the aforesaid cut; including also:

(5) transforming the mercaptans into dialkyldisulfides obtained from the mercaptans (DSO);

(6) hydrogenating the DSO into $H_2S$; and (7) reacting the $H_2S$ thus obtained in step (6) according to the Claus reaction.

In one embodiment, the Claus reactions of steps (2) and (7) are carried out jointly.

In one embodiment, the flow obtained in step (6) is recycled towards the gas to be treated.

In one embodiment, the process further comprises step (8), i. e. the mixing of the $H_2S$ obtained in step (6) with the flow of acid gases containing the $H_2S$ separated in step (1).

In one embodiment, step (1) is a washing step with an amine and the flow obtained in step (6) is recycled towards said washing step (1) with an amine.

In one embodiment, step (1) is a washing step with an amine, this step comprising the following sub-steps:

(a) producing a sweetened gas and a flow of amine charged in acid gases (b) flash separating the amine charged in acid gases into a first flow of amine to be regenerated and a flow of residual hydrocarbons, (c) washing the residual hydrocarbon flow with an amine and producing a second flow of amine to be regenerated, (d) introducing the flow obtained in step (6) to the sub-step (c)

(e) combining the two flows of amine and regenerating them.

In one embodiment, the process further comprises step (1a) of concentration of the $H_2S$ from the said flow of acid gases by selective washing with an amine, and the flow obtained in step (6) is recycled towards step (1a) of selective washing with an amine by mixing with the said flow of acid gases.

In one embodiment, the process further comprises step (1a) of concentration of the $H_2S$ of the said flow of acid gases by selective washing with an amine, this step comprising the following sub-steps:

(a) producing a flow of $CO_2$ and a first flow of amine charged selectively in $H_2S$, (b) regenerating the first flow of charged amine and obtaining a flow of $H_2S$ and a flow of regenerated amine, (c) contacting one part of the said regenerated amine with the flow obtained in step (6) to produce a flow of hydrocarbons and a second flow of amines charged selectively in $H_2S$, (d) regenerating the second flow of charged amine and obtaining a flow of 5 $H_2S$.

In one embodiment, the process comprises, between steps (c) and (d), the following sub-steps:

(g) flash separating the second flow of charged amine and obtaining a second flow of charged degassed amine and a gaseous flow, and optionally (h1) recycling the second gaseous flow towards the sub-step (a), or (h2) combining the said second gaseous flow with the flow of $CO_2$ produced in the sub-step (a).

In one embodiment, the step (3) concentrating the mercaptans in at least one cut of the said sweetened gas comprises producing at least one cut comprising propane and/or butane and/or condensates.

In one embodiment, the step (3) concentrating the mercaptans in at least one cut of the said sweetened gas comprises producing sweetened gas containing less than 30ppm, preferably less than 10 ppm, advantageously less than 2 ppm of mercaptans.

In one embodiment, the step (3) of concentration of the mercaptans in at least one cut of said sweetened gas comprises the extraction of Liquid Petroleum Gas by a cryogenic method.

In one embodiment, the step (3) of concentration of the mercaptans in at least one cut of said sweetened gas comprises condensing the Liquid Petroleum Gas during the liquefaction of the gas to be treated.

In one embodiment, the gas to be treated containing the mercaptans and the acid gases is a natural gas or a gas containing hydrogen, preferentially a refinery gas.

The invention also provides a process of treatment of a cut containing mercaptans, comprising the above steps (5), (6) and (7).

The invention also provides a process of conversion of dialkylsulfide from mercaptans (DSO) comprising the above steps (6) and (7).

The invention also proposes an installation for the treatment of gases containing mercaptans and acid gases, comprising the following elements:

(1) a unit for separating the acid gases from said gas and obtaining a sweetened gas and a flow of acid gases containing $H_2S$, (2) a sulfur production unit of the Claus type connected to a separation unit, (3) a mercaptan concentration unit in at least one cut of said sweetened gas connected to the separation unit, (4) a unit for washing with a base the mercaptans from the said cut and for regenerating the base, transforming the mercaptans into dialkylsulfides obtained from the mercaptans (DSO), the said unit for washing and regenerating being connected to the mercaptan concentration unit, (5) a unit for hydrogenating DSO into $H_2S$ connected to the unit for washing with a base and regenerating the base, and (6) a Claus-type sulfur production unit connected to the hydrogenation unit.

In one embodiment, the two sulfur Claus-type production units form a single unit.

In one embodiment, the hydrogenation unit is connected to the separation unit via a pipe.

In one embodiment, the separation unit is a unit for separating by washing with an amine, this unit comprising the following elements:

(a) a column producing at the head a flow of sweetened gas and at the bottom a flow of amine charged in acid gases, (b) a flash separation vessel for separating the amine charged in acid gases into a first flow of amine to be regenerated and a flow of residual hydrocarbons, (c) connected to the head of the said vessel, a column for washing with an amine the residual hydrocarbons flow and for producing a second flow of amine to be regenerated, (d) a pipe connecting the hydrogenation unit to the bottom of the said column (e) a pipe at the bottom of the vessel combining the two amine flows, and (f) a regeneration unit.

In one embodiment, the installation also comprises a unit for concentrating in $H_2S$ the said flow of acid gases by selective washing with an amine, the flow obtained at the step (6) being recycled towards the unit for the selective washing with an amine.

In one embodiment, the installation also comprises a unit for concentrating in $H_2S$ the said flow of acid gases by selective washing with an amine, this unit comprising the following elements:

(a) a first column producing at the head a flow of $CO_2$ and at the bottom a first flow of amine selectively charged in $H_2S$, (b) a column for regenerating the first flow of charged amine and for obtaining at the head a flow of $H_2S$ and at the bottom a flow of regenerated amine, (c) a column, for washing with an amine, connected by a pipe to the said bottom, (d) a pipe connecting the hydrogenation unit to the said column, the said column producing at the head a flow of hydrocarbons and at the bottom a second flow of amine selectively charged in $H_2S$, and (e) a pipe connecting the bottom with the second flow of amine with the regeneration column.

In one embodiment, the installation further comprises a flash separation vessel producing, at the head, a gas flow, and, at the bottom, a second flow of degassed charged amine, the line which connects the bottom with the second amine flow to the regeneration column connecting then the bottom of the vessel with the regeneration column, and optionally a pipe connecting the head of the vessel to the first column or a pipe connecting the head of the vessel to the head of the first column.

The invention also provides an installation for the treatment of a cut containing mercaptans comprising units (4), (5) and (6) above.

The invention provides also an installation for the conversion of dialkylsulfides from mercaptans (DSO) comprising units (5) and (6) above.

DETAILED DESCRIPTION OF THE EMBODIMENTS OF THE INVENTION

The process according to the invention applies to the treatment of a natural gas or refinery gas when LPG are extracted by a cryogenic route and to Liquefied Natural Gas (LNG) when the LPG are condensed during the liquefaction.

In the following description, the example of natural gas is used without restraint to the scope of the invention.

Figure 1:
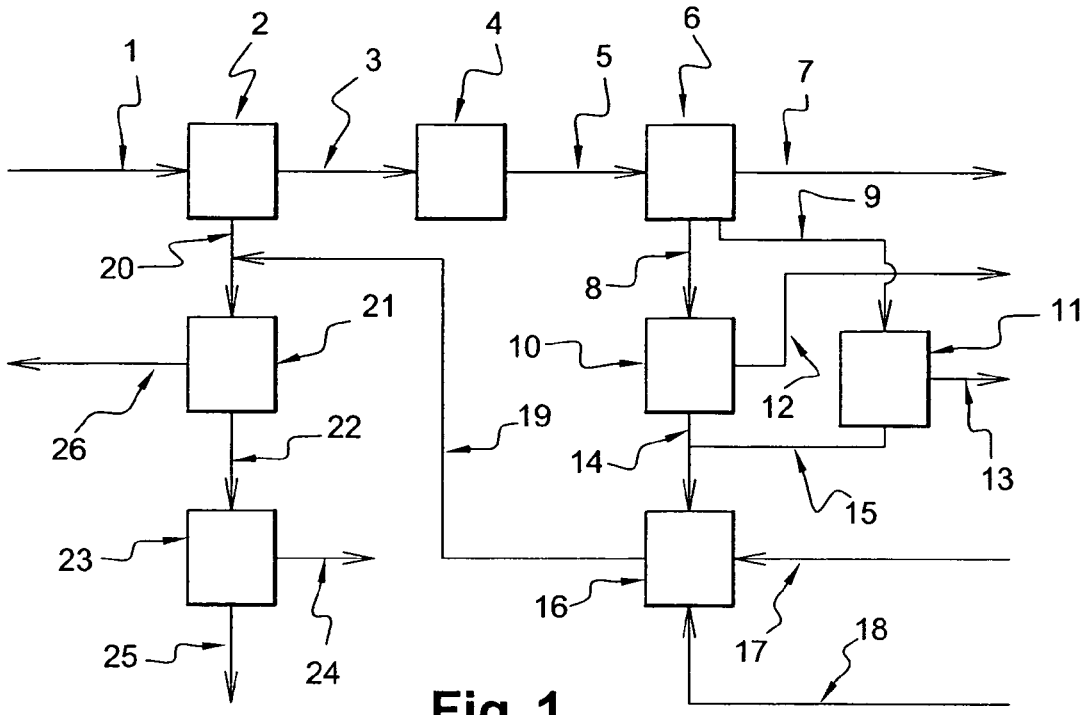
FIG. 1 shows schematically the process according to the invention

The description of the invention focuses on FIG. 1, general flow-sheet.

The natural gas (1) is cleaned of the acid gases $H_2S$ and $CO_2$ in the amine washing unit (2). According to the desired specification, the amine solutions can be based on DEA (di-ethanol amine), MDEA (methyl-di-ethanol amine) or activated MDEA from any other solution. The sweetened gas (3) is then dried in unit (4). According to the water dew point desired, the drying process is based on the utilization of a glycol and, more particularly, of triethylene glycol (TEG) or molecular sieves. The dried and sweetened gas (5) is therefore introduced into the gas treatment unit (6). The unit (6) is either a unit for extracting LPG by a cryogenic method or by washing with heavy oil, or a liquefaction unit in which LPG is separated by cryogenic condensation. The unit (6) generally assures the fractionation; classically it comprises a di-ethaniser, a di-propaniser and a di-butaniser.

The gas, in the form of a liquid or vapour, according to the process used, is extracted via (7). The propane and butane are extracted respectively via (8) and (9). This natural gas (7) satisfies the specifications for sulfur, and the mercaptans present in the natural gas are found concentrated in the butane and the propane. They are treated by washing with sodium hydroxide in the units (10) and (11). The propane and butane which are free from mercaptans, under the commercial specification values, are extracted via (12) and (13), respectively. The sodium hydroxide solution used is regenerated with air before being returned in units (10) and (11). The DSO produced is extracted from units (10) and (11) via (14) and (15) and the mixture is introduced into unit (16) where it is hydrogenated.

The hydrogenation reactions can be classically carried out on a catalyst, in particular cobalt-molybdenum. The reaction for the dimethyldisulfide is given by following equation:

$$CH_3SSCH_3+3H_2 \rightarrow 2CH_4+2H_2S \text{ (reaction A)}$$

The equations for the diethyldisulfide and the heavier disulfides are in all respects similar.

The hydrogen necessary for the reaction A is introduced into the hydrogenation unit 16 via 17. The hydrogenation reaction is extremely exothermic and could give rise to an uncontrolled augmentation in temperature. In order to moderate the increase in temperature a fluid which does not participate within the reaction is injected, preferably via 18, the role of said fluid being to act as a thermal reserve to limit the rise in temperature during the reaction. To do this, nitrogen, natural gas, vaporised LPG propane or butane, water vapour or even naphtha can, for example, be used. The mixture from the hydrogenation containing principally $H_2S$ and hydrocarbons, in excess of the constituent used as a thermal reserve, is extracted via 19 of the unit 16. This mixture equally contains the excess of hydrogen not consumed in the reaction.

The operation conditions of the reaction A are typically a pressure of 15 to 35 bar, and, preferably, of 22 to 25 bar and a temperature of at least 150° C.

The acid gases $H_2S$ and $CO_2$ separated from the natural gas in the unit 2 are extracted from it via 20. They are at low pressure, typically from 1 to 4 bars abs. According to the concentrations of $H_2S$ and $CO_2$ contained in the natural gas, the relative proportions of these two constituents in the flow of acid gas 20 are variable. As a general rule, the aim is to eliminate the sulfur present in the $H_2S$, in the Claus-reaction-based unit. Firstly, the $H_2S$ is partially oxidized according to the reaction $$H_2S+3/2O_2 \rightarrow SO_2+H_2O$$

in order to obtain a mixture of $SO_2$ which reacts with the non-oxidized $H_2S$ to give sulfur and water:

$$2H_2S+SO_2S+2H_2O \text{ reaction B, called Claus reaction}$$

To obtain the satisfactory conditions for flame stability, the partial oxidation of the $H_2S$ is generally carried out at a temperature comprised between 1000 and 1100° C. If the acid gas 20 contains too much $CO_2$ with respect to the $H_2S$, the $CO_2$ plays a role of thermal moderator, and the flame cannot reach the optimal temperature required. Therefore, it is in general necessary that the $H_2S$ content in the acid gas is higher than the value assuring flame stability. Below this value, we may have an enrichment in $H_2S$ of the acid gas. This operation takes place in unit 21, which is, therefore, optional according to the operating conditions. It consists in washing the acid gas with an amine solution MDEA that selectively absorbs the $H_2S$ and which does not absorb the most part of $CO_2$. The MDEA solution is regenerated by distillation an operation effected in the unit 21, from which is obtained the flow rich in $H_2S$ 22. The latter can therefore feed the sulfur production unit 23, also known as the Claus unit, where the Claus reaction B is carried out, and from where a flow of liquid sulfur 24 results. The tail gases are taken from the Claus unit via 25 and may optionally be submitted to standard transformation methods.

The inert gases come out of the system via 26.

The flow 19 from the hydrogenation 16 of DSO is brought to the entry of the unit 21 for enrichment of the acid gas 20. The $H_2S$ produced by the hydrogenation 16 is also selectively absorbed there by the solution of MDEA before being also sent towards the sulfur production unit 23.

The sulfur contained in the DSO is thus reduced to a chemical component, $H_2S$, for which the treatment is well known and is currently carried out industrially.

One of the advantages of the invention is to increase the $H_2S$ content of the flow feeding the sulfur production unit 23. Thus, as indicated above, this unit is preferentially fed by an acid gas having a minimal $H_2S$ content, in order to obtain a sufficiently high flame temperature. Further, it is known that, according to the prior art, one of the possible ways to eliminate the DSO consists in transforming it by incineration into $SO_2$, and after washing the smoke, sending the $SO_2$ thus recuperated into the sulfur production unit. However, the sulfur contained in the DSO cannot now participate in raising the flame temperature because it is already in an oxidized form upon arrival from the sulfur production unit. By contrast, in the process according to the invention the sulfur content in the DSO arrives at the sulfur production unit in a form of $H_2S$, which actively maintains the flame temperature.

It was also mentioned that another method of eliminating DSO is directly incinerating in the sulfur production unit, but that the latter only accepts a limited quantity of DSO with respect to the $H_2S$. In the process according to the invention, there is no limitation to the quantity of DSO produced because the sulfur contained in the DSO is sent directly into the sulfur production unit in a form of $H_2S$. The process according to the invention is capable of treating all gases, no matter what their relative content in $H_2S$ and mercaptans is. It is even possible to introduce DSO which, after hydrogenation, will contribute to raising the $H_2S$ content at the entry of the Claus unit 23.

Lastly, it is possible to put into operation the process according to the invention in the existing natural acid gas treatment plants that are equipped with a sulfur production unit. It suffices to add a DSO hydrogenation unit to the installation already in place. Once the hydrogenation unit is installed, the DSO produced by washing the mercaptans with sodium hydroxide, will no longer be incinerated or mixed with the condensates or sent to the Claus unit, but sent to the hydrogenation unit to be transformed into $H_2S$ to be sent to the Claus unit.

Figure 2:
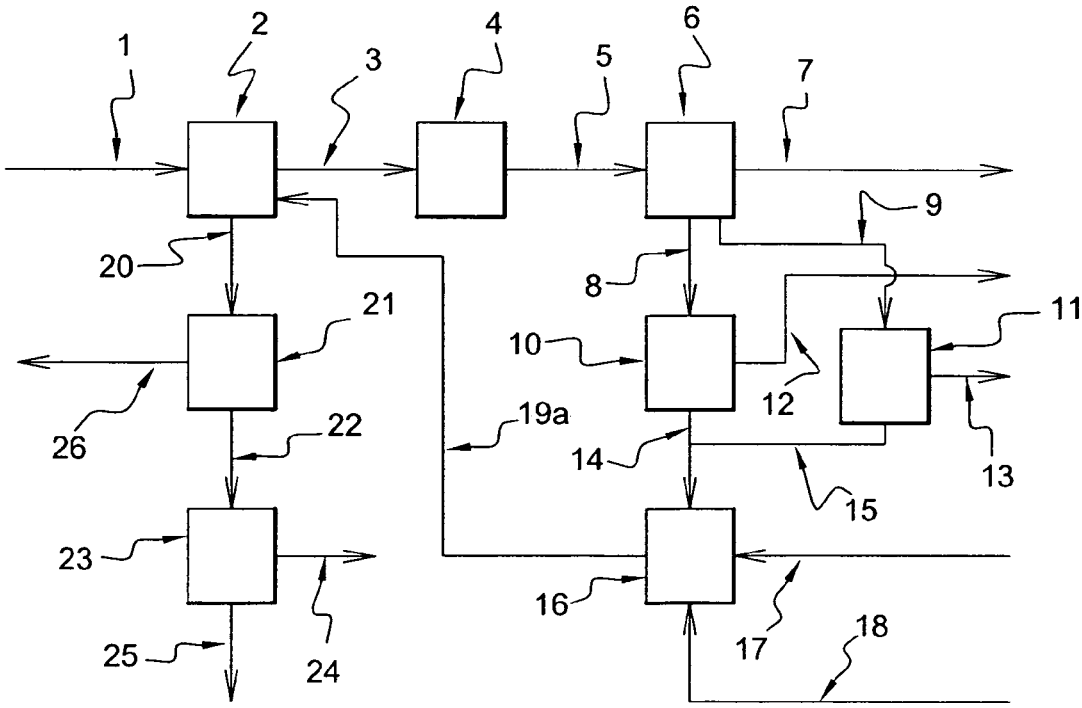
FIG. 2 shows a first embodiment of the process according to the invention
Figure 2A:
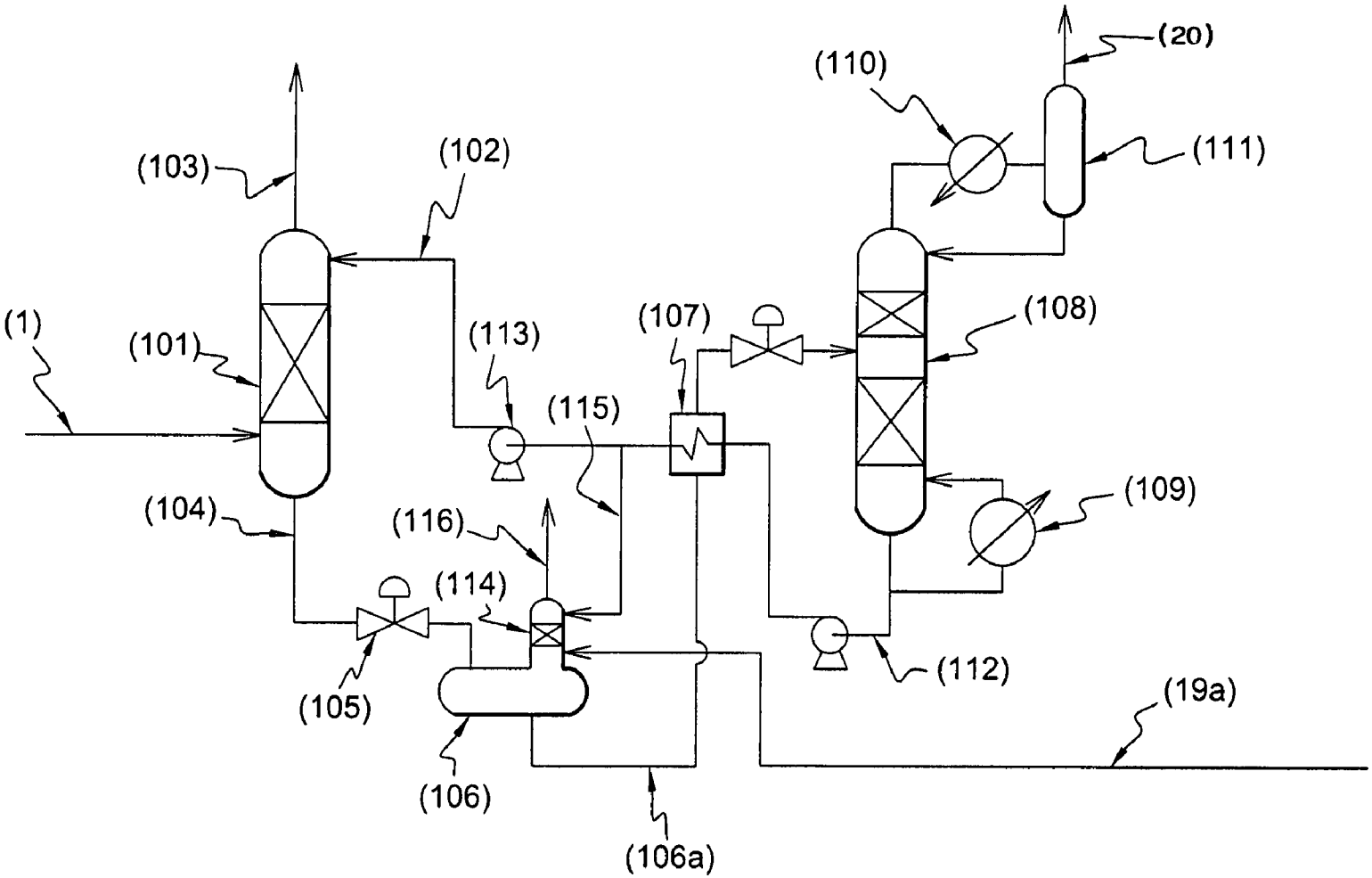
FIG. 2*a* shows a detailed view of the first embodiment of the process according to the invention

A first embodiment of the process according to the invention is represented in FIG. 2, in which the flow 19*a* from the hydrogenation of DSO is brought into the amine washing unit 2. The description of the principle of the amine washing unit 2 is based on FIG. 2*a*.

The acid natural gas 1 enters into the wash column 101 where it is put in counter-flow contact with an aqueous amine solution 102 (MEA, DEA, MDEA, or activated MDEA) that absorbs the acid gases $H_2S$ and $CO_2$. The purged natural gas is extracted via 103. The amine solution charged in acid gas, known as a rich solution, is extracted at the bottom 104 and is released to an intermediate pressure (typically from 5 to 15 bar), typically, by a valve 105. The release provokes the vaporization of a part of the dissolved gas, in particular the hydrocarbons and a small part of the acid gas. The gases are separated from the liquid in a flash vessel 106. The amine solution, extracted via the pipe 106*a*, is then reheated in an exchanger 107 before being introduced into a regeneration column 108 which usually functions at a pressure close to atmospheric pressure. The regeneration column comprises a reboiler 109 and a condenser 110. The acid gases $H_2S$ and $CO_2$ are extracted via 20 at the head of the reflux vessel 111 and the amine solution is regenerated at the bottom 112. It is re-chilled in 107 while preheating the rich amine, and is pumped to the high pressure of the natural gas in 113 before being again introduced into the wash column 101.

The liberated gases in the flash vessel 106 are hydrocarbons mixed with acid gases. In general they are not in a state suitable for utilization and they need to be cleaned of acid gases. This is the role of the absorption column 114. One part 115 of the regenerated amine in 112 is sent to the head of the column 114, and the flash gas produced by the expansion of the amine solution via 104 in 105 is washed in order to absorb the acid gases it contains. The hydrocarbons are extracted at the head via 116.

The gas from the hydrogenation unit 16 contains principally $H_2S$ and hydrocarbons. It is therefore worthwhile recuperating the hydrocarbons and using them as fuel, but the high $H_2S$ content in the output of the unit 16 makes the gas 19 unsuitable for direct utilization, and consequently it must be de-acidified. It is particularly worthwhile to carry out this operation jointly with that of the washing of the flash gas resulting from the expansion in 105. The gas from the hydrogenation unit 16 is introduced via line 19*a* at the bottom of the column 114 and, after purifying with the amine solution from 115, is extracted via 116 with the flashed hydrocarbons.

Figure 3:
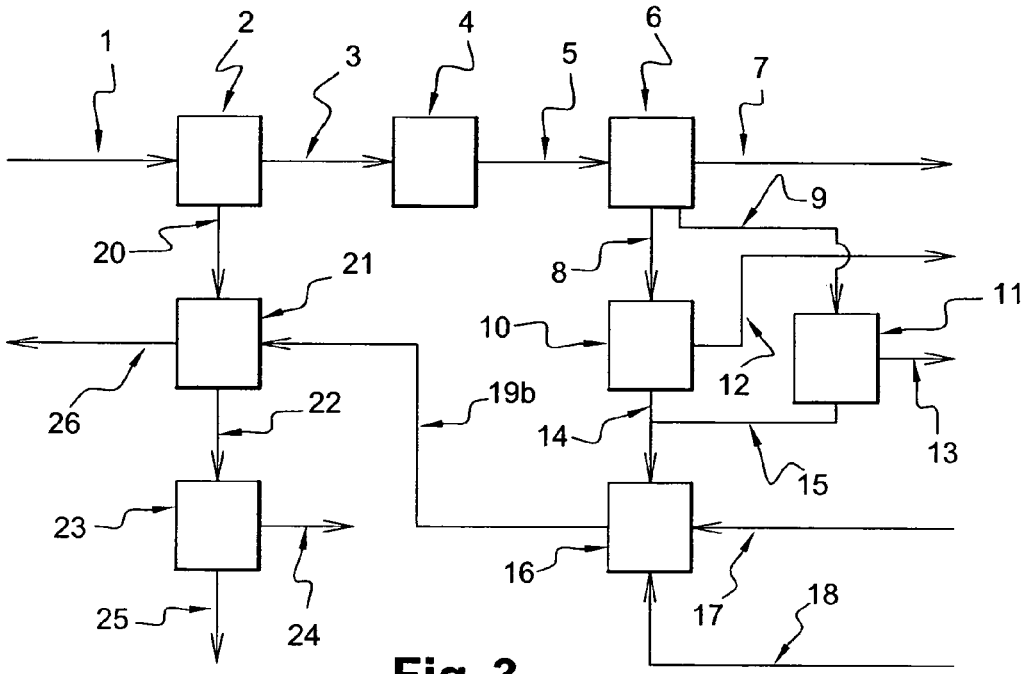
FIG. 3 shows a second embodiment of the process according to the invention

A second embodiment of the process according to the invention is to bring the flow 19*b* from the DSO hydrogenation 16 directly into the enrichment unit 21. This second embodiment is represented in FIG. 3.

The enrichment unit 21 is very similar in its principle to the amine washing unit 2. Its purpose is to separate the $H_2S$ from the carbon dioxide in order to send to a gas sufficiently rich in $H_2S$ to the sulfur production unit 23, in order to assure a high enough flame temperature.

Figure 3A:
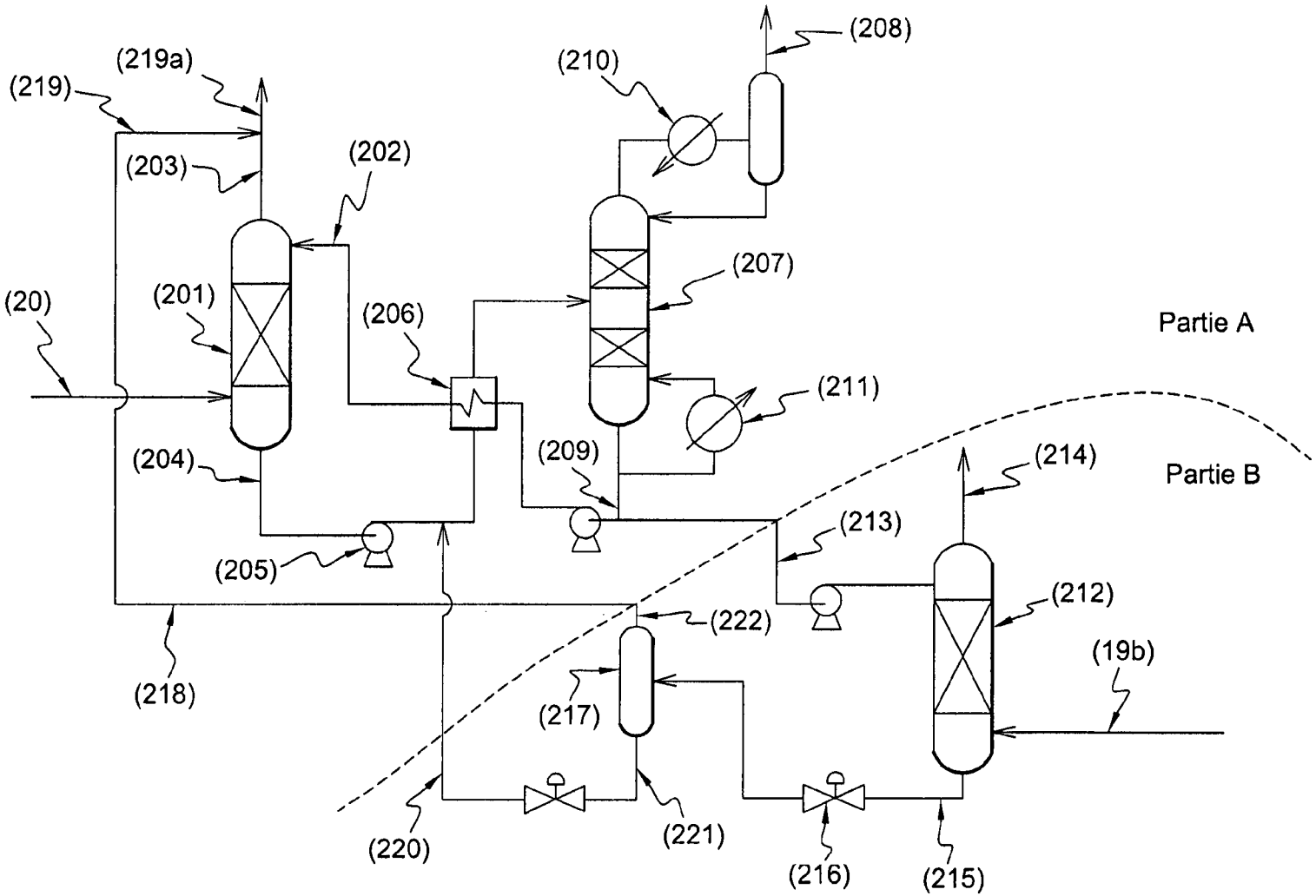
FIG. 3*a* shows a detailed view of a mode of realization of the second embodiment of the process according to the invention

The description of the principle of the enrichment unit 21 is based on FIG. 3*a*.

The acid gas 20 is introduced at the bottom of the absorption column 201 where it is put in counter-flow contact with a solution of MDEA 202 which preferentially absorbs $H_2S$. The carbon dioxide scrubbed in $H_2S$ is extracted at the head 203. The rich amine from the charged $H_2S$ is extracted at the bottom 204, pumped by 205 and, after preheating in 206 by hot regenerated amine, is introduced into the regeneration column 207. $H_2S$ is produced at the head 208 and regenerated amine at the bottom 209. The regeneration column 207 is equipped with a condenser 210 and a reboiler 211. The regenerated amine is returned to the absorber 201 via the exchanger 206.

According to a first alternative embodiment, the gas from the hydrogenation unit 16 is sent, at the same time as the gas 20, into column 201. According to a more advantageous second alternative embodiment a supplementary unit is added.

In the first alternative embodiment of the invention, the gas 19 from the hydrogenation is mixed with acid gas 20 and treated simultaneously. However columns 201 and 207 function at a pressure close to atmospheric pressure, whereas hydrogenation unit 16 functions preferentially at a pressure of about 25 bar. There would, therefore, be a loss to release the pressure of gas 19 for its treatment on the column 201.

FIG. 3*a* is divided into 2 parts: part A and part B. The equipment shown in part A is taken from the prior art. In contrast, to put into operation the second alternative of the second embodiment of the process according to the invention, we attach the equipment present in part B to the enrichment unit 21, which is now described.

The gas from the hydrogenation unit 16 is introduced by pipe 19*b* into a column 212 where it is put in counter-flow contact with a part 213 of the regenerated amine 209. The washed hydrocarbons are extracted at the head via 214 and available under pressure. They can also be directly used as combustible gas, in particular given their pressure, in gas turbines.

The solution that is rich in amine is extracted at the bottom via 215. Advantageously, it is expanded in 216 and the flashed gases are separated in the vessel 217. The amine solution is therefore extracted at the bottom via 221 and returned by pipe 220 to regeneration after mixing with the principal flow 204. The flash gases extracted at the head via 222 are sent by a pipe 218 to the acid gas of pipe 20 or sent by a pipe 219 to the carbon dioxide 203. The resulting mixture (pipe 219*a*) in the last case is, in general, incinerated for elimination of the last traces of $H_2S$.

The second embodiment thus makes it possible to take advantage of the pressure of the gas of pipe 19 from the hydrogenation unit.

Figure 4:
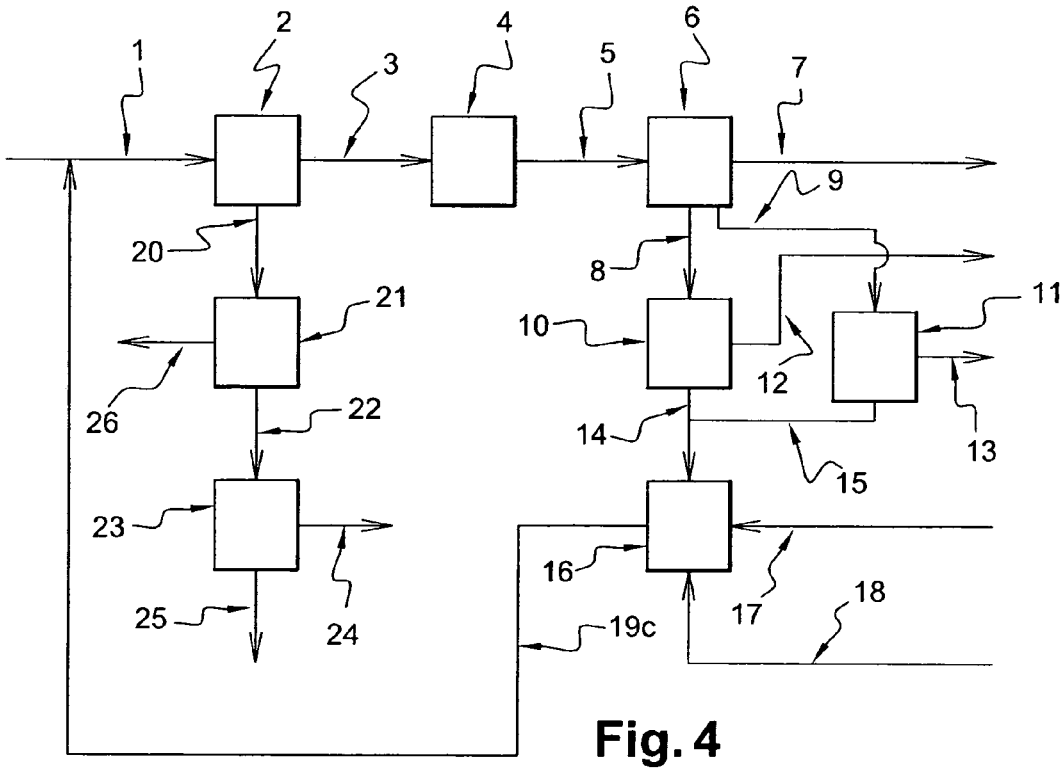
FIG. 4 shows a third embodiment of the process according to the invention.

According to a third embodiment of the process according to the invention shown in FIG. 4, the gas resulting from the hydrogenation of DSO is sent by line 19*c* to pipe 1 of the natural gas, with which it is mixed after having been compressed. Therefore there is no longer any distinction between it and the natural gas and the $H_2S$ contained in the flow 19 is sent to the sulfur production unit 23 via units 2 and 21.

To conclude, it is worth noting that the process according to the invention and its first and third embodiment can also be put in operation without the presence of an enrichment unit 21; in this case the flow 20 enters directly into the Claus unit 23. In fact, as mentioned above in the description, the enrichment unit 21 is only necessary when the $H_2S/CO_2$ ratio is too low. The ratio of $H_2S/CO_2$ is a function of the composition of the natural gas, on which depends therefore, the presence of the enrichment unit 21.

The following example illustrates the invention without limiting its scope.

EXAMPLE

The example given below corresponds to the process according to the first alternative of the second embodiment.

The natural gas 1 is treated successively in the units 2 and 4 and is liquefied in the unit 6. During liquefaction, the propane and the butane are extracted and the mercaptans are consequently simultaneously condensed. They are treated by washing with sodium hydroxide in units 10 and 11 and the DSO is produced at 14 and 15. After hydrogenation in 16 where the natural gas is used as a diluent to limit the temperature rise, the DSO transformed into $H_2S$ is sent to the entry of the enrichment unit 21. The liquefied natural gas 7 meeting the sulfur content specifications is produced directly by condensation of mercaptans without supplementary treatment.

The material balance given below (Table) allows one to follow the migration of the sulfur contained in the mercaptans. This Table gives the composition and the rates of the principal flows. Certain flows are not numbered but are obvious mixture of two flows (A) and (B): therefore marked (A)+(B).

This material balance is voluntarily simplified for the sake of clarity. In particular, it does not make apparent the products that could form during the secondary chemical reactions in the units 10 and 11 for the treatment of LPG, nor those resulting from parasitic chemical reactions during the hydrogenation. These reactions are very minor and have no major influence on the global balance.

Unless, otherwise indicated, the units are expressed in percent. The ppm are indicated.

| | 1 | 5 | 8 | 9 | 14 + 15 | 19 | 19 + 20 |
|---|---|---|---|---|---|---|---|
| $N_2$ | 3.30 | 3.39 | — | — | — | 3.22 | 0.26 |
| $H_2S$ | 0.26 | 4 ppm | — | — | — | 5 | 10.16 |
| $CO_2$ | 2.19 | 50 ppm | — | — | — | — | 82.27 |

-continued

| | 1 | 5 | 8 | 9 | 14 + 15 | 19 | 19 + 20 |
|---|---|---|---|---|---|---|---|
| $CH_4$ | 85.45 | 87.53 | — | — | — | 83.17 | 6.63 |
| $C_2H_6$ | 5.43 | 5.56 | 2.00 | — | — | 5.28 | 0.42 |
| $C_3H_8$ | 1.93 | 1.98 | 96.00 | 2.00 | — | 1.88 | 0.15 |
| $iC_4H_{10}$ | 0.35 | 0.36 | 1.8 | 37.78 | — | 0.34 | 0.03 |
| $nC_4H_{10}$ | 0.53 | 0.54 | 0.2 | 57.22 | — | 0.51 | 0.04 |
| $C_5$+ | 0.55 | 0.63 | — | 2.00 | — | 0.60 | 0.05 |
| $CH_3SH$ | 19 ppm | 12 ppm | 655 ppm | 1145 ppm | — | — | — |
| $C_2H_5SH$ | 123 ppm | 114 ppm | 10 ppm | 10165 ppm | — | — | — |
| $C_3H_7S$+ | 38 ppm | 35 ppm | — | — | — | — | — |
| DMDS | — | — | — | — | 16.00 | — | — |
| DEDS | — | — | — | — | 84.00 | — | — |
| Throuput kmole/h | 37703 | 36789 | 402 | 333 | 2.01 | 80 | 1004 |

DMDS = dimethyldisulfide
DEDS = diethyldisulfide

The difference in mercaptan content between flows 1 and 5 is due to their absorption into the amine solution.

The total number of kmoles/h of $H_2S$ fed to the sulfur production unit 23 is 102 from which 4 come from mercaptans via the hydrogenation of DSO. The flow of $H_2S$ for the Claus unit 23 is thus raised by more than 4%.

It is clearly seen from the table one of the advantages of the process. If the DSO had been incinerated prior to its introduction into the Claus unit 23, these 4 kmole/h of sulfur would have been introduced in the form of $SO_2$, and this would have made necessary a greater enrichment in $H_2S$ in the Claus unit 23.

The invention claimed is:

1. Process for the treatment of a gas containing mercaptans and acid gases comprising the following steps:

(1) separating the acid gases from the said gas and obtaining a sweetened gas and a flow of acid gases containing the $H_2S$;

(2) subjecting the $H_2S$ obtained in step (1) to a Claus reaction;

(3) concentrating the mercaptans in at least one cut of the said sweetened gas;

(4) extracting the mercaptans from the said cut, (5) transforming the mercaptans into dialkyl-disulfides obtained from the mercaptans (DSO);

(6) combining hydrogen with the DSO and hydrogenating DSO into $H_2S$; and (7) subjecting the $H_2S$ thus obtained in step (6) to a Claus reaction.

2. Process according to claim 1, in which the Claus reactions of the steps (2) and (7) are carried out jointly.

3. Process according to claim 2, in which the flow obtained in the step (6) is recycled to the gas to be treated.

4. Process according to claim 2, further comprising a step (8) in which the $H_2S$ obtained in step (6) is mixed with the flow of acid gases containing the $H_2S$ separated in step (1).

5. Process according to claim 2, in which step (1) comprises washing with an amine and the flow obtained in step (6) is recycled to the step (1) washing with an amine.

6. Process according to claim 2, in which step (1) comprises washing with an amine and this step comprises the following sub-steps:

(a) producing a sweetened gas and a flow of amine charged in acid gases, (b) flash separating the amine charged in acid gases into a first flow of amine to be regenerated and a flow of residual hydrocarbons, (c) washing the flow of residual hydrocarbon with an amine and producing a second flow of amine to be regenerated, (d) introducing the flow obtained in step (6) to the sub-step (c), (e) combining the two flows of amine and regenerating them.

7. Process according to claim 2, further comprising a step (1*a*) of concentrating the $H_2S$ in said flow of acid gases by selective washing with an amine, and recycling the flow obtained in step (6) towards step (1*a*) of selective washing with an amine by mixing with the said flow of acid gases.

8. Process according to claim 2, further comprising also a step (1*a*) of concentrating the $H_2S$ in the said flow of acid gases by selective washing with an amine, step (1*a*) comprising the following sub-steps:

(a) producing a flow of $CO_2$ and a first flow of amine charged selectively in $H_2S$, (b) regenerating the first flow of charged amine and obtaining a flow of $H_2S$ and a flow of regenerated amine, (c) contacting a part of the said regenerated amine flow with the flow obtained in step (6) to produce a flow of hydrocarbons and a second flow of amine selectively charged in $H_2S$, and (d) regenerating the second flow of charged amine and obtaining a flow of $H_2S$.

9. Process according to claim 8, comprising between steps (c) and (d), the following sub-steps:

(g) flash separating the second flow of charged amine and obtaining a second degassed flow of charged amine and a gaseous flow, and optionally (h1) recycling the second gaseous flow to the sub-step (a) or (h2) combining said second gaseous flow with the flow of $CO_2$ produced in sub-step (a).

10. Process according to claim 1, in which step (3) for concentrating the mercaptans in at least one cut of the said sweetened gas comprises producting of at least one cut comprising propane, butane, condensates or a mixture thereof.

11. Process according to claim 1, in which step (3) for concentrating the mercaptans in at least one cut of the said sweetened gas comprises the producing sweetened gas containing less than 30 ppm of mercaptans.

12. Process according to claim 1, in which step (3) for concentrating the mercaptans in at least one cut of the said sweetened gas comprises the cryogenic extraction of the Liquefied Petroleum Gases.

13. Process according to claim 1, in which step (3) for concentrating the mercaptans in at least one cut of the said sweetened gas comprises the condensing of the Liquefied Petroleum Gases during the liquefaction of the gas to be treated.

14. Process according to claim 1, for the treatment of the gas containing mercaptans and acid gases in which the gas is a natural gas or a gas containing hydrogen.

15. Process for liquefying natural gas into Liquefied Natural Gas, comprising the process of claim 1 in which the gas is a natural gas and the natural gas is liquefied.

16. Process of treatment of a cut containing mercaptans comprising the steps (5), (6) and (7) of claim 1.

17. Process of treatment of dialkyl-disulfides from mercaptans (DSO) comprising the steps (6) and (7) of claim 1.

18. Installation for the treatment of a gas (1) containing mercaptans and acid gases comprising the following elements:

(1) a separation unit for separating acid gases from the said gas and for obtaining a sweetened gas and a flow of acid gases containing $H_2S$;

(2) a Claus sulfur production unit connected to the separation unit;

(3) a concentrator unit for concentrating the mercaptans in at least one cut of the said sweetened gas connected to the separation unit;

(4) a washing and separation unit for washing with a base the mercaptans of the said cut and for regenerating the base, transforming the mercaptans into dialkyledisulfides (DSO), the said washing and regenerating unit being connected to the mercaptans concentration unit;

(5) a hydrogenation unit for hydrogenating DSO into $H_2S$, connected to the washing and regeneration unit; and (6) a Claus sulfur production unit connected to the hydrogenation unit.

19. Installation according to claim 18, in which the two sulfur Claus production units form a single unit.

20. Installation according to claim 19, in which the hydrogenation unit is connected to the separation unit by a first pipe.

21. Installation according to claim 19, in which the separation unit comprises the following elements:

(a) a first column producing at a head thereof a flow of sweetened gas and at a bottom thereof a flow of amine charged in acid gases, (b) a flash separation vessel for separating the amine charged in acid gases into a first amine flow to be regenerated and a flow of residual hydrocarbons, (c) connected to the head of the vessel, a second column for washing the residual hydrocarbon flow with an amine and for producing a second flow of an amine to be regenerated, (d) a first pipe connecting the hydrogenation unit to the bottom of the said second column, (e) a second pipe at the bottom of the vessel which combines the two flows of amine, and (f) a regeneration unit.

22. Installation according to claim 19, further comprising a concentrator unit for concentrating $H_2S$, the concentrator unit connected to the hydrogenation unit.

23. Installation according to claim 19, further comprising a concentrator unit for concentrating the $H_2S$ in the said flow of acid gases by selective washing with an amine, comprising the following elements:

(a) a first column producing at a head thereof a flow of $CO_2$ and at a bottom thereof a first flow of an amine charged selectively in $H_2S$, (b) a second column for regenerating the first flow of charged amine and obtaining at a head thereof a flow of $H_2S$ and at a bottom thereof a flow of regenerated amine, (c) a washing column for washing with an amine connected by a first pipe to the bottom of the second column, (d) a second pipe connecting the hydrogenation unit with the said washing column, said washing column producing at a head thereof a flow of hydrocarbons and at a bottom thereof a second flow of amine charged selectively in $H_2S$, and (e) a third pipe connecting the bottom of the second pipe with the second amine flow to the regeneration column.

24. Installation according to claim 23, further comprising a flash separation vessel producing at a head thereof a gaseous flow and at a bottom thereof a second degassed charged amine flow, the third pipe connecting the bottom of the vessel with the regeneration column and, optionally, a fourth pipe connecting the head of the vessel to the first column or a fifth pipe connecting the head of the vessel to the head of the first column.

25. Installation for the treatment of a cut containing mercaptans, comprising the units (4), (5) and (6) of claim 18.

26. Installation for treatment of dialkyl-disulfides from mercaptans (DSO) comprising the units (5) and (6) of claim 18.

27. Process according to claim 1, in which step (3) for concentrating the mercaptans in at least one cut of the said sweetened gas comprises producing sweetened gas containing less than 10 ppm of mercaptans.

* * * * *